United States Patent [19]

Paul et al.

[11] Patent Number: 4,796,948

[45] Date of Patent: Jan. 10, 1989

[54] PATIENT SUPPORT SYSTEM FOR WHEELCHAIRS AND THE LIKE

[76] Inventors: Patrick R. D. Paul, 13100 Pelican Watch Villas, Johns Island, S.C. 29455; James H. Price, 1118 Shadow Lake Cir., Mt. Pleasant, S.C. 29464; Kenneth Olshansky, 7029 Chowning Cir., Richmond, Va. 23229

[21] Appl. No.: 829,312

[22] Filed: Feb. 14, 1986

[51] Int. Cl.[4] ..... A47C 7/14; A47C 27/08

[52] U.S. Cl. ..... 297/284; 297/DIG. 3; 297/DIG. 4

[58] Field of Search ..... 297/284, DIG. 3, DIG. 4; 5/446, 447

[56] References Cited

U.S. PATENT DOCUMENTS

| | | | |
|---|---|---|---|
| 3,330,598 | 7/1967 | Whiteside | 297/284 |
| 3,652,126 | 3/1972 | Folling | 297/284 |
| 3,867,732 | 2/1975 | Morrell | 297/284 X |
| 4,132,228 | 1/1979 | Green | 297/DIG. 3 X |
| 4,175,297 | 11/1979 | Robbins et al. | 297/DIG. 3 X |
| 4,524,762 | 6/1985 | Schulman | 128/33 |

FOREIGN PATENT DOCUMENTS

| | | | |
|---|---|---|---|
| 629620 | 3/1963 | Belgium | 297/DIG. 3 |
| 2625277 | 12/1977 | Fed. Rep. of Germany | 297/284 |
| 2856177 | 7/1980 | Fed. Rep. of Germany | 297/284 |

OTHER PUBLICATIONS

Medical & Biological Engineering & Computing publication, R. B. Roemer, May 1979, pp. 379–382.

*Primary Examiner*—Francis K. Zugel
*Assistant Examiner*—Peter R. Brown

[57] ABSTRACT

An improved support system for a person in a sitting attitude to vary pressures produced on affected body areas adequate to improve blood perfusion thereat. A first, primary resilient support element is provided that defines a generally centrally located opening with a second, inflatable fluid support element received therein. The inflatable support element is located to receive the ischial tuberosities thereover and is normally deflated whereby minimal pressures are generated on body areas thereover. Fluid may be supplied to the second support element to inflate same, thereby supporting a greater proportion of the body weight and lowering pressures generated on the portions contacting the first support element. A valve controllably inflates and deflates the second element. A timer may be employed to activate an air compressor to inflate the second support element after a predetermined interval. Cyclic pressure changes permit all affected body areas to enjoy good blood perfusion periodically, enhancing comfort and lessening the likelihood of development of ulcers for a person sitting on the support system. The system may be incorporated into a wheelchair.

9 Claims, 2 Drawing Sheets

PATIENT SUPPORT SYSTEM FOR WHEELCHAIRS AND THE LIKE

BACKGROUND OF THE INVENTION

The present invention relates to an improved support system to receive a patient or other individual confined to a wheelchair or other type seat for prolonged periods of time. Continued contact between the buttocks of an individual and the seat support therebeneath can create pressure on the buttocks leading to discomfort, decreased blood flow in the affected area and even the development of decubitus ulcers. The system of the present invention improves overall patient comfort, improves blood flow and reduces the incidence of development of ulcers.

Heretofore, a great deal of development effort has been expended toward improving wheelchairs and other types of seats which receive and hold non-ambulatory persons for extended periods of time. While great strides have been made for support systems for receipt of patients in a supine position so as to avoid the incidence of decubitus ulcers and the like, successes have not heretofore been achieved for patients in a sitting attitude. In fact, virtually no systems are known for use in wheelchairs and other similar type seats for improved prolonged sitting conditions with the exception of foam cushions of various densities and configurations, conventional air inflated cushions of various shapes and designs, gel filled cushions, water filled cushions and attenuating pressure pads or devices. In such prior art arrangements, the devices have generally been of singular construction, that is the entire surface of the support cushion is basically the same.

While support structures of the type described above do, in fact, add to the general comfort of the patient, constant pressures persist against the affected body portions of the patient such that ultimate discomfort results as well as a reduction of blood flow which could lead to the development of decubitus ulcers or pressure sores. In fact, since the whole upper body weight of a person is supported by the relatively small body area in the wheelchair seat, extremely high pressures may be experienced, up to about 200 mm Hg, on the ischial tuberosities. No system presently available as exemplified above is capable of achieving pressures low enough to prevent the development of pressure sores or ulcers in the most acute cases. No such system has thus been successfully employed in the wheelchair type environment as is contemplated by the present invention. Presently recommended techniques for wheelchair-ridden patients require the patient to periodically physically lift and hold himself off the cushion with his arms for as great a period of time as possible, thus removing pressure from the buttocks during the lift periods. While such techniques are certainly better than nothing, only limited success may be achieved thereby, while at the same time leading to extreme fatigue of the patient if the procedure is practiced over any extended period of time.

In general, body tissue without bony prominence thereunder will withstand higher pressures before tissue damage occurs. Conversely, body tissue having bony prominence therebeneath, such as the ischial tuberosities, is subject to the development of ulcers at lower surface pressures due to higher pressures generated at the tissue-bone interface. In order, therefore, to provide optimal support, it is necessary to provide a support system in which pressures generated on bony prominences, such as the ischial tuberosities is normally lower than the pressures on the surrounding areas of the buttocks.

The present invention achieves the aforementioned optimal situation, and provides a novel system for supporting a patient in a sitting position while at the same time improving patient comfort and reducing the incidence of the likelihood of development of decubitus ulcers. There is no known prior art that is believed to anticipate or suggest the present invention.

SUMMARY OF THE INVENTION

It is an object of the present invention to provide an improved patient support system for wheelchairs and the like.

Another object of the present invention is to provide an improved seating arrangement for one confined in a sitting attitude for prolonged periods of time.

Still further another object of the present invention is to provide an improved cushion arrangement for use in a wheelchair or the like.

Yet another object of the present invention is to provide an improved method for adding to the comfort of one confined in a sitting attitude for prolonged periods of time while reducing the incidence of the development of decubitus ulcers.

Generally speaking, the improved patient support system according to the present invention comprises a first resilient support means; a second, fluid support means juxtaposed to said first support means according to a predetermined arrangement; means operatively associated with said second support means for supplying fluid thereto; and means associated with said fluid supply means for controlling the supply of fluid to said second support means according to a predetermined arrangement whereby pressures exerted on affected body portions are varied, leading to improved blood perfusion, enhanced comfort and a lessening of the likelihood of development of decubitus ulcers at points of pressure.

More specifically, in a preferred embodiment of the present invention, a foam annulus is provided as a first or principal, resilient support means, having a predetermined shape to serve as a peripheral cushioning material for receipt of the patient thereon. A second inflatable element serves as the second support means, is received within the annulus of the principal support means and is operatively connected to a supply of fluid, preferably air. An air compressor powered by alternating or direct current provides air for inflation of the second support means adequate to properly support a patient in a sitting attitude thereon, preferably to raise the patient slightly off the principal support means. A bleed valve is associated with the fluid supply means and may be adjustable according to the weight of a patient residing on the cushion or to operate on a predetermined timing sequence. The bleed valve thus determines the maximum fluid pressure within the second support means and also permits a controlled deflation of same. Additionally, control means, preferably timer control means, may be operatively associated with the fluid supply means to periodically inflate the second support means.

The first and second support means are intended to exert different pressures on respective affected body portions. When the second support means is deflated, as is normal, surface pressures under the ischial tuberosities which are most vulnerable to damage are very low. By periodically inflating the second support means, pressures under the ischial tuberosities are increased while pressures generated on the other areas are reduced to provide improved blood perfusion thereat. Pressures may thus be controlled at all areas to ensure good blood perfusion and thus lessen the likelihood of ulcers. The method according to the present invention is thus accomplished by periodic inflation of the normally deflated second support means adequate to relieve pressures exerted on body portions contacting the first, resilient support means, thus allowing improved blood circulation in the portions residing on said first support means. Thereafter, deflation of the second support means beyond a predetermined level shifts pressures to the previously unaffected body portions contacting the first support means whereby full blood circulation returns to the body portions below the ischial tuberosities. Such periodic pressure shifting thus achieves overall improved blood circulation across the body portion contacting the seat, resulting in enhanced comfort and a lessening in the likelihood of development of ulcers.

BRIEF DESCRIPTION OF THE DRAWINGS

A construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Figure 1:
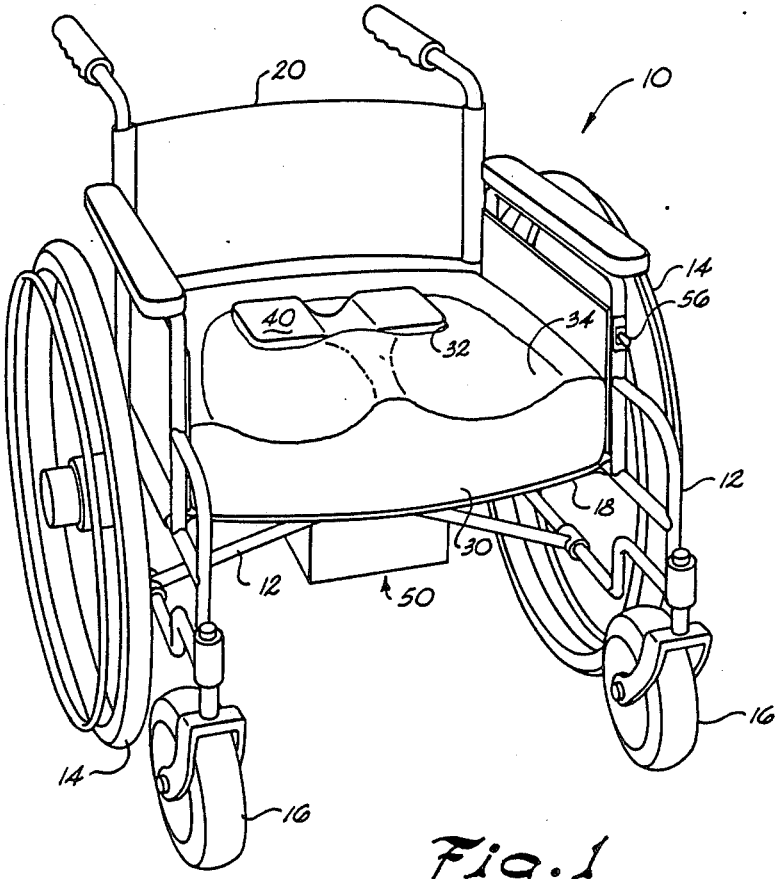
FIG. 1 is an isometric view of a wheelchair equipped with a patient support system according to the present invention.

Making reference to the figures, preferred embodiments of the present invention will now be described in detail. FIG. 1, for example, illustrates a typical installation of a patient support system according to the present invention. A wheelchair generally indicated as 10 is provided, exemplary of a chair, seat or the like, with which the support system of the present invention may be utilized. As can be seen in FIG. 1, chair 10 includes a support frame 12 to which conventional wheels 14 and 16 are secured for ordinary mobility of chair 10. Support frame 12 has a seat support surface 18 and a back support surface 20 secured thereto, again both of conventional construction though either or both could be modified for permanent installation of a support system according to the present invention thereon.

As also illustrated in FIG. 1, located atop the seat surface 18 and thus forming a surface on which a person would reside in a sitting attitude is a first principal support means 30 that is configured for receipt within the normal wheelchair seat area. First support means 30 is an annular structure having a generally rectangular outer periphery. An annulus 32 is defined in an interior portion of same located to receive the ischial tuberosities thereover. First support means 30 may be any resilient material that will afford comfort to a person sitting thereon, but preferably is a polymeric foam cushion type material, the resilience of which affords comfort while at the same time having adequate density or firmness that a person sitting thereon will not totally compress same. While cushion 30 is illustrated as an annulus, such is not required, and cushion 30 may take any other shape so long as an open portion of same is located to receive the ischial tuberosities thereover. A most preferred embodiment, as can be seen from FIGS. 1, 2 and 3 of first support means 30 is also provided with an upper contour that is conducive to comfort. Note, for example, in FIG. 3, that upper surfaces 34 taper inwardly from an outer periphery 35 of same to annulus 32, thus defining somewhat of a central depression on an upper surface of support means 30. Also, as may be seen in FIG. 1, upper surface 34 of first support means 30 is also preferably contoured for receipt of a person's legs.

Figure 3:
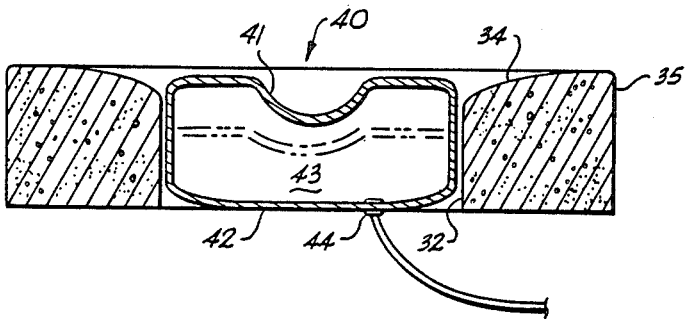
FIG. 3 is a vertical cross-sectional view through the support system as illustrated in FIG. 2 taken along the line III—III.
Figure 4:
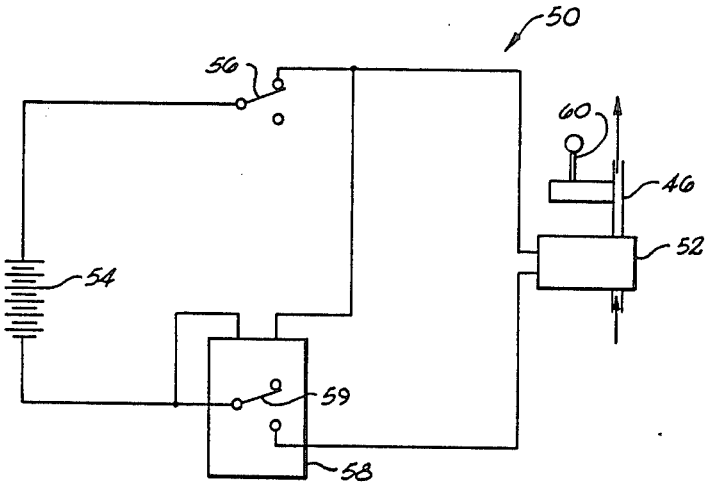
FIG. 4 is a schematic illustration of an embodiment of operative control circuitry associated with a patient support system according to the present invention.

A second, inflatable support means generally 40 is located within annulus 32 and is intended to be positioned with respect to the patient such that the ischial tuberosities of the patient are located thereover. While inflatable support means 40 may assume any desired shape and construction, a polymeric envelope 42 is preferred having a connector element 44 located in a wall of same. Most preferably, as shown in FIGS. 1 and 3, support means 40 includes a depressed area 41 in an internal portion of same, whereby, when inflated, the increased pressures are developed only on the ischial tuberosity areas. A tubular conduit 46 is secured to connector 42 in communication with an interior chamber 43 defined by envelope 42. An opposite end of tubular conduit 46 is operatively associated with a fluid supply means generally indicated as 50 (see FIG. 4) for supplying air under pressure to the interior of fluid support means 40 for proper inflation of same.

Fluid supply means 50 includes an air compressor 52 which is operatively connected with tubular conduit 46 placing same in communication with interior chamber 43 of inflatable support means 40. Air compressor 52 is also electrically connected to a source of power 54 illustrated as a battery, though an alternating current power source could equally be utilized in conjunction with the present invention. In a most preferred embodiment, fluid supply means 50 is secured to a wheelchair 10 with the power source being rechargeable batteries which are also secured to the chair frame 12 for movement therewith. A master switch 56 for determining the state of operativeness of the overall system is provided between the source of power 54 and compressor 52, and in a wheelchair environment could be located on an arm of the chair (FIG. 1) or some other location conveniently accessible to a patient. Likewise, electrically connected between power source 54 and air compressor 52 for operation when master switch 56 is in the on position is a timer control means 58 which may be preset according to the dictates of the system to actuate and deactuate compressor 52 according to a predetermined time sequence. A bleed valve 60 is also provided between air compressor 52 and inflatable support means 40 for the purpose described hereinafter.

With the control means 50 as described above, when air compressor 52 is actuated, air is supplied via tubular conduit 46 to interior chamber 43 of inflatable support means 40 to properly inflate same to a degree similar to that illustrated in solid line in FIG. 3, to a maximum pressure as dictated by bleed valve 60. Inflatable support means 40 is intended to remain fully inflated for a predetermined period of time only. For example, bleed valve 60 may be adjusted to the weight of a person sitting on the support system of the present invention. The person's weight then overcomes the resistance of the bleed valve 60 whereby air escapes therethrough in a controlled manner to achieve deflation of support means 40. Such adjustment also controls the maximum fluid pressure within means 40 as noted above. With timer means 58 preset according to the rate of deflation of inflatable support means 40 based in part on the patient's weight, after a predetermined period of time, timer switch 59 will close to return power to compressor 52 whereby support means 40 will be reinflated. Alternately, timer means 58 may control off-on operation of both bleed valve 60 and air compressor 52 in a set time controlled sequence.

In operation, inflatable support means 40 should remain deflated for about 80 to 90 percent of the time during which the other portions of the buttocks and the thighs bear virtually all of the body weight with pressures developed on the vulnerable ischials being minimal. During the remaining about 10 to 20 percent of the time, support means 40 may be inflated to cause the ischial tuberosities to support most of the body weight, thus relieving pressure from the other affected body areas. Hence timer means 58 could be preset to cause compressor 52 to maintain support means 40 inflated for only one to two minutes every 10 minutes while opening bleed valve 60 and deactuating compressor 52 during the remaining eight to nine minutes of the ten minute cycle. Such one to two minute period is generally not adequate time at the higher pressure to create tissue damage, and thus is acceptable.

In the normal mode of operation with support means 40 deflated, first support means 30 develops pressures on the buttocks and thigh areas ranging from about 40 to 60 mm Hg, while the buttocks area under the ischial tuberosities receives minimal pressures, generally below about 20 mm Hg. At such minimal pressure levels on the ischial tuberosities, tissue damage is unlikely. When support means 40 is inflated, pressures are generated on areas of the buttocks under the ischial tuberosities in a range of about 100 to about 150 mm Hg. Inflation of support means 40 further lifts the patient slightly off the primary support means 40, permitting a reduction of pressures generated on the remaining buttocks and thighs of about 20 mm Hg. Such reduction permits good blood perfusion in the areas where the reduced pressures exist, while the increased pressures generated by inflated support means 40 are not maintained for a long enough period to create tissue damage thereat.

Systematic inflation and deflation of inflatable support means 40 can thus effectively shift pressure emphasis from one body area to another so long as the duration of inflation is not long enough to create tissue damage. Such procedure permits good blood perfusion in all of the affected body areas, significantly reducing the incidence of decubitus ulcers, and also greatly enhances comfort of the individual sitting on the support. A further important characteristic of the support of the present invention is found in the fact that should the inflatable support means 40 fail, the ischial tuberosities will receive the generally minimal pressures noted above and should not experience tissue damage.

Figure 2:
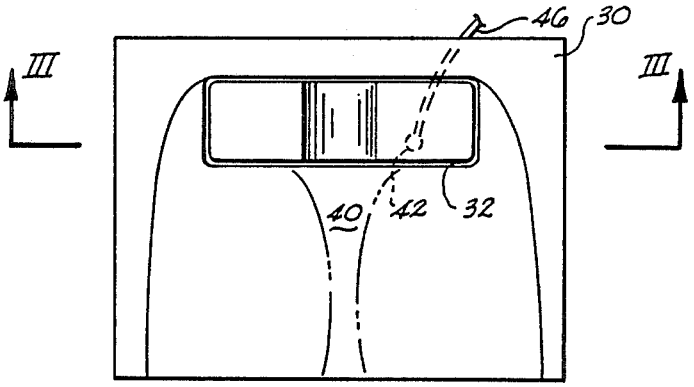
FIG. 2 is a top plan view of a patient support system according to the present invention.

Preferred embodiments of the present invention have been described above. A number of changes, however, could be made thereto. For example, both the first and second support means could be inflatable with inflation and deflation cycles as described above so as to vary pressures on the affected body areas of a person residing thereon. Moreover, if desirable, the shapes of the various support means may vary from that as illustrated in FIGS. 1 through 3 so long as the intended result is accomplished. Likewise, the control system may be modified as well as other parts of the system so long as the intended result is achieved. All-in-all, the scope of the present invention should be determined by the claims appended hereto.

What is claimed:

1. An improved support system for a patient in a sitting attitude comprising:

(a) first resilient support means for supporting body portions of the patient proximate the ischial tuberosities of the patient, said first support means forming an annulus region therein for unsupported receipt of the ischial tuberosities of the patient;

(b) normally deflated inflatable second fluid support means, situated in annulus region of said first support means and configured accordingly, for receiving and supporting upon periodic inflation thereof ischial tuberosities of the patient upon fluid being supplied to said second fluid support means adequate to relieve pressures exerted on patient body portions contacting said first resilient support means;

(c) means associated with said second support means for supplying fluid thereto; and (d) means associated with said fluid supply means for automatically controlling supply of fluid to and from said second support means for inflating and deflating said second support means according to a predetermined arrangement whereby pressures exerted on affected body portions of a patient residing atop said first and second support means are varied so that the supporting of the patient is alternatingly substantially performed by said normally deflated second fluid support means receiving said ischial tuberosities when said second fluid support means is periodically inflated and by said first resilient support means receiving said body portions proximate said ischial tuberosities when said second fluid support means is deflated, thereby leading to improved blood perfusion thereat;

(e) timer means operatively associated with said means for automatically controlling supply of fluid for periodically admitting fluid to said second fluid support means according to a predetermined timing sequence only so that said second support means is normally deflated for minimizing surface pressures to the ischial tuberosities of the patient; and (g) valve means operatively associated with said second fluid support means for regulating said redetermined arrangement of inflation and deflation dependent on the weight of a patient.

2. An improved support system as defined in claim 1 wherein said first support means is annular is shape and has adequate density that same is not fully compressed by a patient sitting thereon.

3. An improved support system as defined in claim 1 wherein said fluid supply means comprises an air compressor.

4. A support system as defined in claim 1 wherein said first support means is polymeric foam having adequate density that complete compression of same by a person sitting thereon is prevented.

5. A support system as defined in claim 4 comprising further a chair, said chair defining a sitting area thereon for receipt of said support system, and wherein said air compressor is powered by at least one rechargeable battery.

6. A support system as defined in claim 5 wherein the chair is a wheelchair.

7. A support system as defined in claim 4 wherein upper surfaces of said first and second support means are contoured for improved comfort.

8. A method for supporting a person in a sitting disposition comprising the steps of:

(a) providing a primary resilient support means and an inflatable support means surrounded by said primary resilient support means and situated beneath the buttocks area of said person, said inflatable support means being located beneath the ischial tuberosities;

(b) normally maintaining the inflatable support means in a deflated state whereby low pressures are generated on body areas below the ischial tuberosities while normal pressures are generated on other body areas in contact with said primary resilient support means;

(c) periodically inflating said inflatable support means for a predetermined period of time to apply an upward force on said buttocks area of said person situated above said second support means sufficient to reduce pressures generated on body areas in contact with said primary resilient support means, which predetermined time of inflation is inadequate to create tissue damage under the ischial tuberosities;

(d) periodically deflating said inflatable support means through action of said person sitting thereon at a rate of deflation which is dependent on the weight of said person;

(e) setting a timer means to a predetermined deflation time according to said rate of deflation of said inflatable support means;

(f) resuming said periodic inflation of said inflatable support means after passage of said predetermined deflation time; and (g) adjusting an adjustable check valve operatively associated with said inflatable support means corresponding to the weight of said person.

9. A method as defined in claim 8, including maintaining said inflatable means in a deflated state for about 80 to about 90 percent of the time said person is sitting thereon and maintaining said inflatable support means in an inflated state for substantially the remainder of the time.

* * * * *

UNITED STATES PATENT AND TRADEMARK OFFICE

CERTIFICATE OF CORRECTION

PATENT NO. : 4,796,948

DATED : January 10, 1989

INVENTOR(S) : Patrick R.D. Paul, James H. Price, Kenneth Olshansky

It is certified that error appears in the above-identified patent and that said Letters Patent is hereby corrected as shown below:

Cover Page, Column 1, change "[76]" to read --[75]--.

Cover Page, Column 1, add --[73] Assignee: SSI Medical Services, Inc., Charleston, S.C.--

Signed and Sealed this

Fourteenth Day of November, 1989

*Attest:*

JEFFREY M. SAMUELS

*Attesting Officer* *Acting Commissioner of Patents and Trademarks*